US009459562B1

(12) United States Patent
Chen et al.

(10) Patent No.: US 9,459,562 B1
(45) Date of Patent: Oct. 4, 2016

(54) ROTATING POWDER DROP STRUCTURE

(71) Applicant: Beijing Xinchen Office Equipment Co.,LTD, Beijing (CN)

(72) Inventors: Bo Chen, Beijing (CN); Ruxu Wang, Beijing (CN)

(73) Assignee: Beijing Xinchen Office Equipment Co.,LTD, Beijing (CN)

( * ) Notice: Subject to any disclaimer, the term of this patent is extended or adjusted under 35 U.S.C. 154(b) by 0 days.

(21) Appl. No.: 14/880,194

(22) Filed: Oct. 10, 2015

(30) Foreign Application Priority Data

Jul. 2, 2015 (CN) ..... 2015 2 0464824

(51) Int. Cl.
*G03G 15/08* (2006.01)

(52) U.S. Cl.
CPC ..... *G03G 15/0898* (2013.01)

(58) Field of Classification Search
CPC combination set(s) only.
See application file for complete search history.

(56) References Cited

U.S. PATENT DOCUMENTS

2014/0241757 A1* 8/2014 Kikuchi ..... G03G 15/0877 399/258

* cited by examiner

*Primary Examiner* — Walter L Lindsay, Jr.
*Assistant Examiner* — Jas Sanghera

(57) ABSTRACT

An improvement rotating powder drop structure includes a toner cartridge, wherein a toner cartridge rear cover is located at a bottom of the toner cartridge, a rear cover sealing gasket is located between the toner cartridge and the toner cartridge rear cover, a driving gear is sleevedly connected to a top of the toner cartridge, a powder exit is provided at an inner side of the driving gear, a powder exit sealing gasket is provided at an inner side of the powder exit, two first powder blocking flakes are respectively symmetrically located at two sides of the powder exit, two second powder blocking flakes are respectively fixed to two first powder blocking flakes, a spring is located within the powder exit, a slide bar is located at a top of the spring, an upper cover is located at the top of the toner cartridge.

4 Claims, 3 Drawing Sheets

ROTATING POWDER DROP STRUCTURE

CROSS REFERENCE OF RELATED APPLICATION

The present invention claims priority under 35 U.S.C. 119(a-d) to CN 201520464824.4, filed Jul. 2, 2015.

BACKGROUND OF THE PRESENT INVENTION

1. Field of Invention

The present invention relates to a printing duplicating machine fitting, and more particularly to an improvement rotating powder drop structure.

2. Description of Related Arts

The laser printing duplicating machine develops by carbon powder. The carbon powder is put into the toner cartridge, when the machine works, the carbon powder gradually flows out of the toner cartridge, so that the development is achieved. During the process of the powder drop, the carbon powder in the existing toner cartridges are not able to smoothly flow out of the toner cartridge, thus affecting the quality of the development.

SUMMARY OF THE PRESENT INVENTION

A technical problem to be resolved in the present invention is to provide an improvement rotating powder drop structure, which is capable of solving deficiencies of the prior art, improving the powder drop smoothness of the toner cartridge, and increasing the powder drop flow rate.

Accordingly, in order to resolve the above technical problem, the present invention adopts the technical solution as follows.

An improvement rotating powder drop structure, comprises a toner cartridge, wherein a toner cartridge rear cover is located at a bottom of the toner cartridge, a rear cover sealing gasket is located between the toner cartridge and the toner cartridge rear cover, a driving gear is sleevedly connected to a top of the toner cartridge, a powder exit is provided at an inner side of the driving gear, a powder exit sealing gasket is provided at an inner side of the powder exit, two first powder blocking flakes are respectively symmetrically located at two sides of the powder exit, two second powder blocking flakes are respectively directly fixed to two first powder blocking flakes, each of the two second powder blocking flakes comprises two first plastic sheets paralleled to each other and a second plastic sheet, wherein the second plastic sheet is located between the two first plastic sheets and vertical to the two first plastic sheets, a spring is located within the powder exit, a slide bar is located at a top of the spring, an upper cover is located at the top of the toner cartridge, an upper cover sealing gasket is provided at a bottom of the upper cover, a locating slide ring is located at the upper cover, and a bottle cap is located at a top of the upper cover.

Preferably, an elastic block button is provided at an outer side of the powder exit, and the elastic block button makes an interference fit with the driving gear.

Preferably, a chip is fixed to the upper cover by a chip support.

The beneficial effects of the present invention which adopts the above technical solution are as follows. By the rotation of the driving gear, the present invention achieves the discharge of the carbon powder under the effect of the slide bar. During the discharge of the carbon powder, the first powder blocking flakes and the second powder blocking flakes collect the carbon powders and put the carbon powders into the machine, so that the powder drop flow rate of the toner cartridge at the single rotation is increased, namely, about 15 g every circle originally is increased to 20-30 g every circle, thus reducing the start time of the machine during the operation and decreasing the electricity energy consumption. Furthermore, the elastic block button is capable of improving the assembling tightness of the driving gear. The whole powder drop structure adopts the split type assembly, every component is capable of separately replacing, and the maintenance cost is low.

These and other objectives, features, and advantages of the present invention will become apparent from the following detailed description, the accompanying drawings, and the appended claims.

Figure 1:
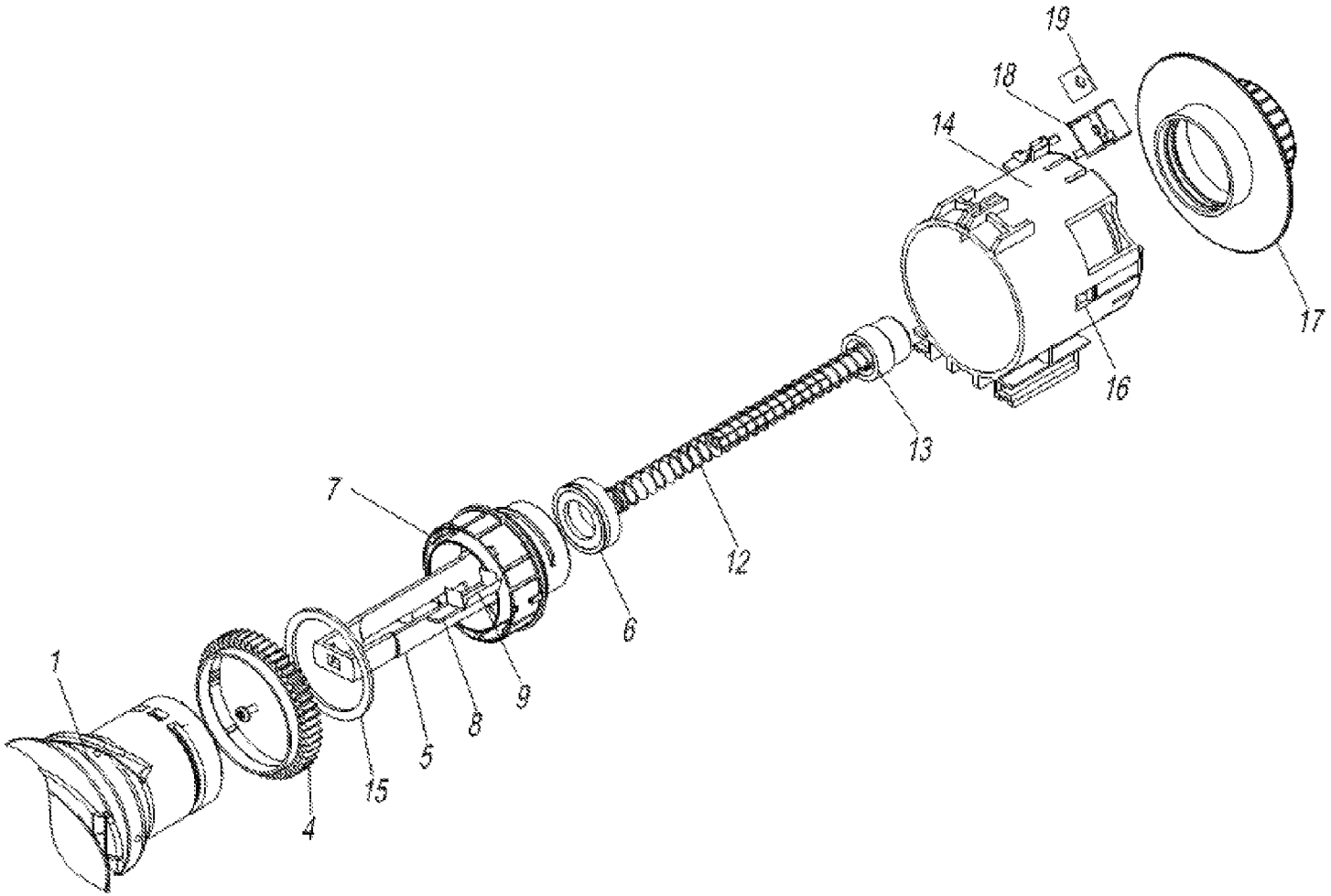
FIG. 1 is a perspective view of an upper portion of a toner cartridge body according to a preferred embodiment of the present invention.

In the drawings: 1: toner cartridge; 2: toner cartridge rear cover; 3: rear cover sealing gasket; 4: driving gear; 5: power exit; 6: powder exit sealing gasket; 7: elastic block button; 8: first powder blocking flake; 9: second powder blocking flake; 10: first plastic sheet; 11: second plastic sheet; 12: spring; 13: slide bar; 14: upper cover; 15: upper cover sealing gasket; 16: locating slide ring; 17: bottle cap; 18: chip support; 19: chip

DETAILED DESCRIPTION OF THE PREFERRED EMBODIMENT

The standard components used in the present invention are able to be purchased from the market, the unusual shape parts are able to be prepared based on the specification and the drawings. The concrete connection of the components is achieved by the existing bolts, rivets, welding, sticking and other conventional manners, which is not described in detail again.

Figure 2:
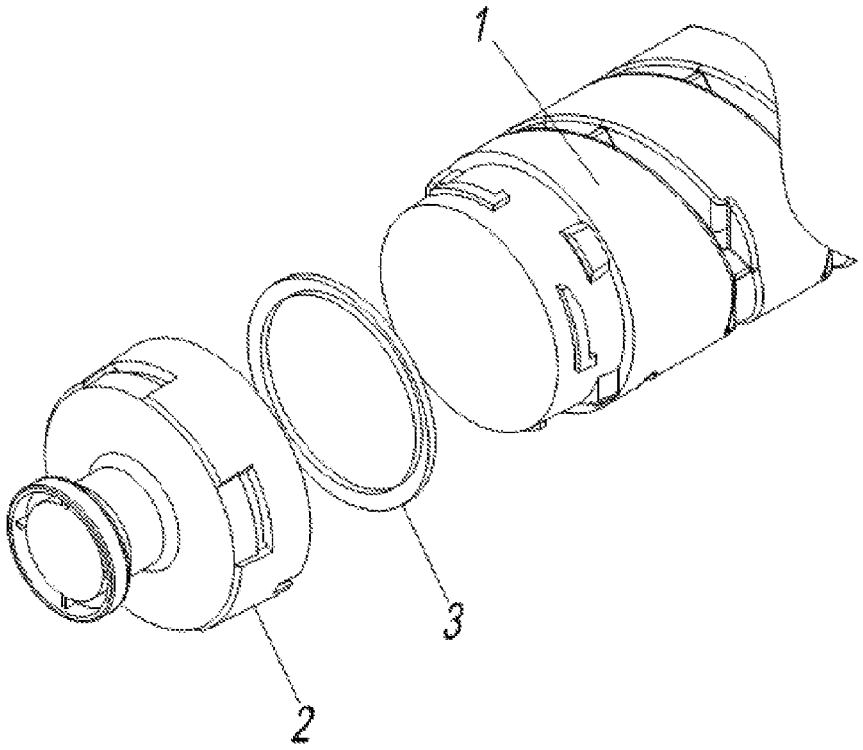
FIG. 2 is a perspective view of a lower portion of a toner cartridge body according to the above preferred embodiment of the present invention.
Figure 3:
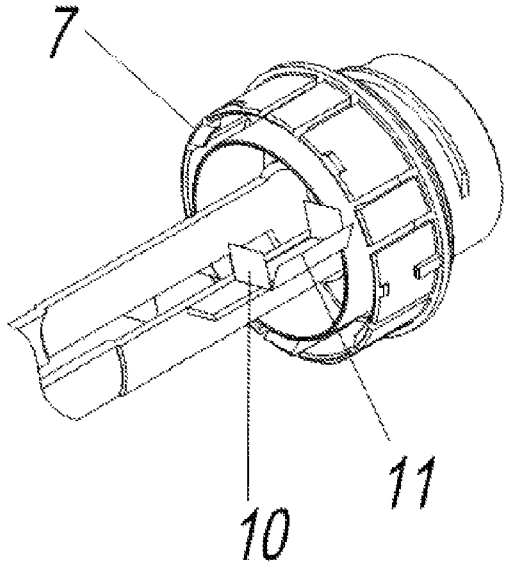
FIG. 3 is a structurally schematic view of a second powder blocking flake according to the above preferred embodiment of the present invention.
Figure 4:
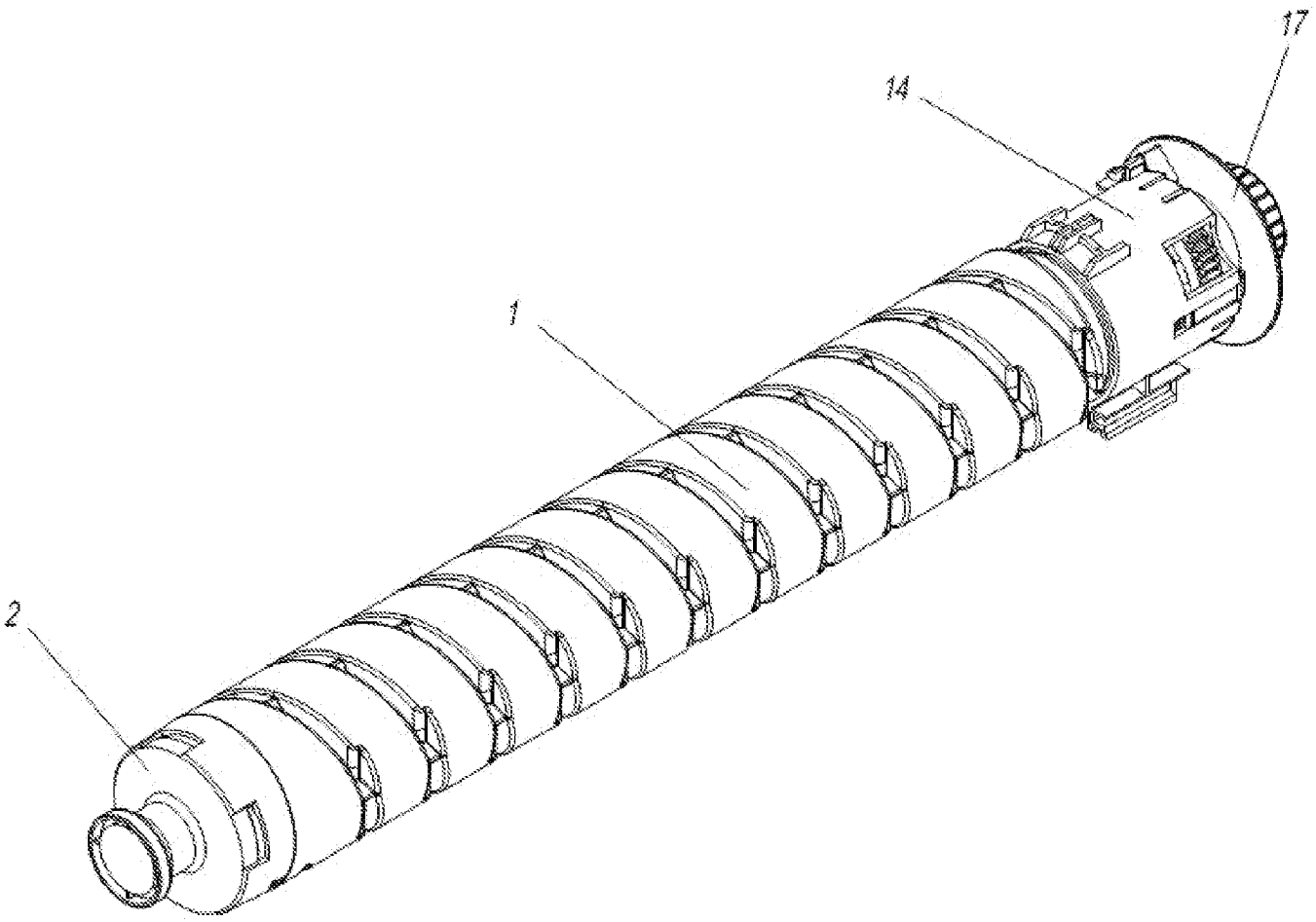
FIG. 4 is an externally structurally schematic view of the rotating powder drop structure after assembly according to the above preferred embodiment of the present invention.

Referring to FIGS. 1 to 4, a rotating powder drop structure according to a preferred embodiment of the present invention is illustrated, comprising a toner cartridge 1, wherein a toner cartridge rear cover 2 is located at a bottom of the toner cartridge 1, a rear cover sealing gasket 3 is located between the toner cartridge 1 and the toner cartridge rear cover 2, a driving gear 4 is sleevedly connected to a top of the toner cartridge 1, a powder exit 5 is provided at an inner side of the driving gear 4, a powder exit sealing gasket 6 is provided at an inner side of the powder exit 5, two first powder blocking flakes 8 are respectively symmetrically located at two sides of the powder exit 5, two second powder blocking flakes 9 are respectively directly fixed to two first powder blocking flakes 8, each of the two second powder blocking flakes 9 comprises two first plastic sheets 10 paralleled to each other and a second plastic sheet 11, wherein the second plastic sheet 11 is located between the two first plastic sheets 10 and vertical to the two first plastic sheets 10, a spring 12 is located within the powder exit 5, a slide bar 13 is located at a top of the spring 12, an upper cover 14 is located at the top of the toner cartridge 1, an upper cover sealing gasket 15 is provided at a bottom of the upper cover 14, a locating slide ring 16 is located at the upper cover 14, and a bottle cap 17 is located at a top of the upper cover 14. An elastic block button 7 is provided at an outer side of the powder exit 5, and the elastic block button 7 makes an interference fit with the driving gear 4. A chip 19 is fixed to the upper cover 14 by a chip support 18. By the rotation of the driving gear 4, the present invention achieves the discharge of the carbon powder under the effect of the slide bar 13. During the discharge of the carbon powder, the first powder blocking flakes 8 and the second powder blocking flakes 9 collect the carbon powders and put the carbon powders into the machine, so that the powder drop flow rate of the toner cartridge at the single rotation is increased, namely, about 15 g every circle originally is increased to 20-30 g every circle, thus reducing the start time of the machine during the operation and decreasing the electricity energy consumption. Furthermore, the elastic block button 7 is capable of improving the assembling tightness of the driving gear 4. The whole powder drop structure adopts the split type assembly, every component is capable of separately replacing, and the maintenance cost is low.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rotating powder drop structure, comprising a toner cartridge (1), wherein a toner cartridge rear cover (2) is located at a bottom of the toner cartridge (1), a rear cover sealing gasket (3) is located between the toner cartridge (1) and the toner cartridge rear cover (2), a driving gear (4) is sleevedly connected to a top of the toner cartridge (1), a powder exit (5) is provided at an inner side of the driving gear (4), a powder exit sealing gasket (6) is provided at an inner side of the powder exit (5), two first powder blocking flakes (8) are respectively symmetrically located at two sides of the powder exit (5), two second powder blocking flakes (9) are respectively directly fixed to two first powder blocking flakes (8), each of the two second powder blocking flakes (9) comprises two first plastic sheets (10) paralleled to each other and a second plastic sheet (11), wherein the second plastic sheet (11) is located between the two first plastic sheets (10) and vertical to the two first plastic sheets (10), a spring (12) is located within the powder exit (5), a slide bar (13) is located at a top of the spring (12), an upper cover (14) is located at the top of the toner cartridge (1), an upper cover sealing gasket (15) is provided at a bottom of the upper cover (14), a locating slide ring (16) is located at the upper cover (14), and a bottle cap (17) is located at a top of the upper cover.

2. The rotating powder drop structure, as recited in claim 1, wherein an elastic block button (7) is provided at an outer side of the powder exit (5), and the elastic block button (7) makes an interference fit with the driving gear (4).

3. The rotating powder drop structure, as recited in claim 1, wherein a chip (19) is fixed to the upper cover (14) by a chip support (18).

4. The rotating powder drop structure, as recited in claim 2, wherein a chip (19) is fixed to the upper cover (14) by a chip support (18).

* * * * *